United States Patent [19]

Saiger

[11] 4,299,423

[45] Nov. 10, 1981

[54] KNOCKDOWN SETTEE

[75] Inventor: Herbert C. Saiger, Troy, Ohio

[73] Assignee: Plantation Patterns, Inc., Birmingham, Ala.

[21] Appl. No.: 103,288

[22] Filed: Dec. 13, 1979

[51] Int. Cl.[3] ..... A47C 4/02

[52] U.S. Cl. ..... 297/440; 108/153; 297/232

[58] Field of Search ..... 297/232, 440, 441, 442, 297/443, 444; 182/181, 182, 183, 184, 185; 108/153, 154, 155

[56] References Cited

U.S. PATENT DOCUMENTS

| | | | |
|---|---|---|---|
| 1,618,803 | 2/1927 | Bokan | 297/443 |
| 2,615,770 | 10/1952 | Curtis | 248/165 X |
| 2,634,172 | 4/1953 | Hollidge | 182/181 |
| 2,744,795 | 5/1956 | McDonough | 182/183 |
| 2,992,442 | 7/1961 | Lehman | 108/154 |
| 3,047,337 | 7/1962 | Carver | 182/185 X |
| 3,114,575 | 12/1963 | Eames et al. | 297/441 X |
| 3,934,697 | 1/1976 | Rice | 182/183 X |
| 3,990,663 | 11/1976 | Hendrickson et al. | 248/188.7 |

FOREIGN PATENT DOCUMENTS

| | | | |
|---|---|---|---|
| 615779 | 2/1961 | Italy | 297/440 |
| 192940 | 3/1964 | Sweden | 297/440 |

*Primary Examiner*—James T. McCall

*Attorney, Agent, or Firm*—Dithmar, Stotland, Stratman & Levy

[57] ABSTRACT

A knockdown settee comprising a pair of double leg members each including two legs, two seat assembly supports and connecting spacers all disposed in a generally common plane; the pair of leg members are rigidly connected by means of a U-shaped cross bar having two legs connected by a bight to create a wedging action, to provide a rigid construction for a seat assembly including a seat, a back and a pair of arms pivoted at the free ends respectively to the sides of the seat and the back. Pins rigidly connect the rear of the seat to the back when the back is pivoted by the arms to the operative position and spaced friction clips are provided at the bottom of the seat for engagement of adjacent seat assembly supports. The seat and the back are moveable into substantial alignment and the double leg members and cross bar when separated may lie on the seat and back below the level of the arms, thereby minimizing space required for packaging and storage.

9 Claims, 7 Drawing Figures

KNOCKDOWN SETTEE

BACKGROUND OF THE INVENTION

Because of high cost of packaging and shipping materials, effort is constantly made to provide an improved method of packaging to minimize the size of the package required and, therefore, to minimize storage and shipping costs. The problem is especially prevalent when shipping objects such as settees or chairs or tables where the ordinary shape of the settee in its assembled form occupies a relatively large space volume but the materials occupy only a small volume.

Efforts to provide folding settees of the type which are moveable between an operative position for sitting and a compact storage position generally have resulted in settees which are flimsy and do not provide a sturdy or solid construction. The compromises and/or trade offs between solid construction and small shipping volume have never been solved satisfactorily with the trade offs resulting inevitably in a solid construction with a large shipping volume or a small shipping volume and a relatively flimsy construction. Representative patents illustrating attempts to solve the above-discussed problems are those to Towns, U.S. Pat. No. 3,258,294 issued June 28, 1966 for Knockdown Chair and to Moxley, U.S. Pat. No. 3,057,661 issued Oct. 9, 1962 for Chair.

SUMMARY OF THE INVENTION

It is a principal object of the present invention to provide a knockdown settee which when assembled is rigid and sturdy and when knocked down provides a compact package for shipping and storage.

Another object of the present invention is to provide a knockdown settee comprising a pair of double leg members each including two legs, two seat assembly supports and connecting spacer structure defining an opening having a pair of parallel sides, the legs and the supports disposed in a generally common plane parallel with the sides of the opening of the spacer structure; a U-shaped cross bar having two legs connected by a bight adapted detachably to connect the pair of double leg members rigidly in operative position, the legs of the cross bar being disposed within the spacer structure openings of the pair of double leg members to function as a wedge and to establish the detachable rigid connections between the cross bar and the pair of double leg members; a seat assembly including a seat, a back and a pair of arms pivoted at the free ends respectively to the sides of the seat and the back; means rigidly connecting the rear of the seat to the back when the back is pivoted by the arms to operative position; and spaced means at the bottom of the seat for attaching engagement of adjacent seat assembly supports of the pair of double leg members connected by the cross bar; whereby the knockdown settee is readily and rigidly assembled by the cross bar, and when disassembled the seat and the back are moveable into substantial alignment and the double leg members and the cross bar when separated may lie on the seat back below the level of the arms, thereby minimizing space required for packaging and storage.

Another object of the present invention is to provide a knockdown settee of the type set forth in which the seat assembly includes a seat, a back and a pair of arms pivoted at the free ends respectively to the sides of the seat and back, the back having a pair of spaced studs adapted to extend through spaced openings at the rear of the seat when the back is pivoted by the arms to operative position, the seat at the front bottom having a pair of spaced means for attaching engagement of adjacent seat assembly supports of a pair of double leg members interfitted by the cross bar; and a pair of detachable means connecting the other two seat assembly supports to the studs at the rear bottom of the seat when the back is in the operative position.

A still further object of the present invention is to provide a knockdown settee of the type set forth wherein each double leg members includes two generally U-shaped components with the spacers being a pair of plates rigidly secured to opposite sides of intermediate portions of the U-shaped components.

These and other objects of the present invention may more readily be understood when taken in conjunction with the accompanying specification in which:

DETAILED DESCRIPTION OF THE INVENTION

Figure 1:
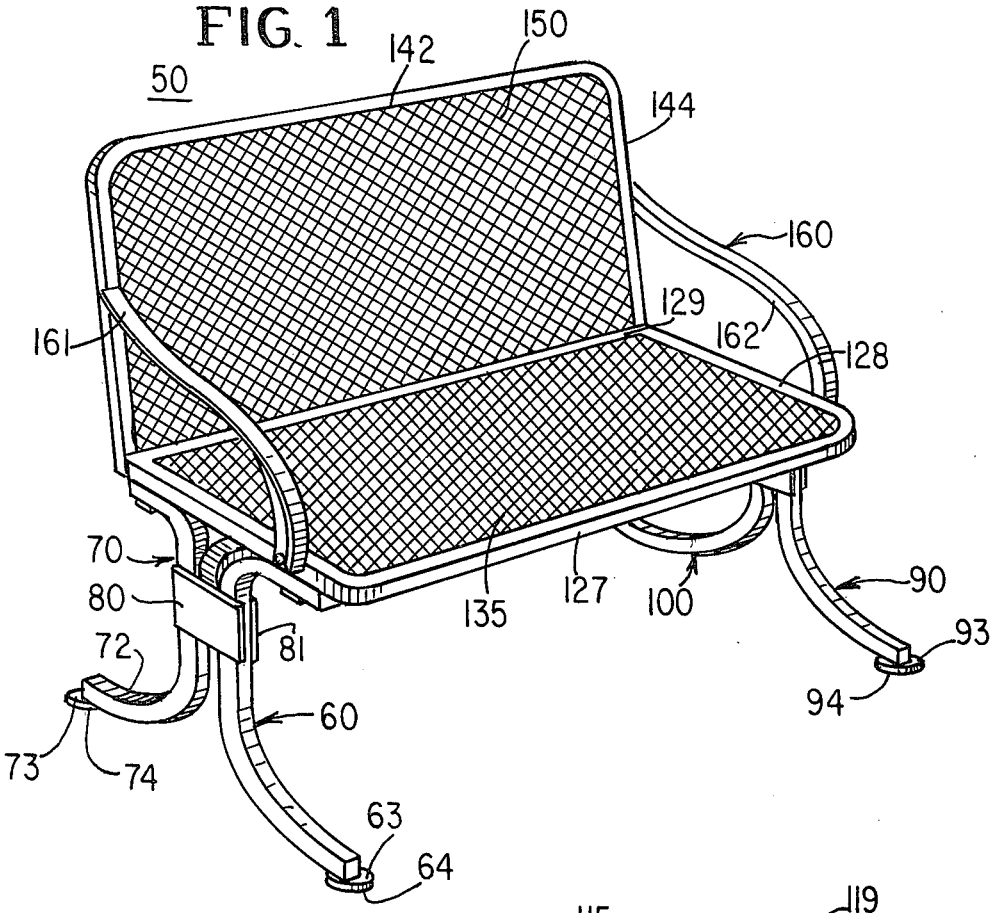
FIG. 1 is a front perspective view of the knockdown settee of the present invention in the fully assembled condition thereof.

Referring now to the drawings there is disclosed a settee 50 including a leg assembly 55 comprised of a double leg member 60 and 70 and a double leg member 80 and 90 and a cross bar 115, with the double leg member 60 and 70 being interconnected by a pair of spacer plates 80 and 81 and the double leg member 90 and 100 being interconnected by a pair of spacer plates 110 and 111, as will be explained. The leg member 60 of double leg member 60 and 70, as shown is tubular, square in transverse cross-section and includes a straight stem 61 which at one end thereof is integral with a gently curved portion 62 terminating in a foot 63 having a flat support surface 64. The other end of the straight stem 61 as shown is integral with a straight seat assembly support portion 66 joined to the straight stem by a 90° elbow 67. The entire leg member 60 is generally U-shaped with the straight stem 61 forming the bight and with the seat support portion 66 and the curved leg portion 62 forming the legs thereof.

Leg member 70 of double leg member 60 and 70, as shown, is tubular, square in transverse cross-section and includes a straight stem 71 which at one end thereof is integral with a gently curved leg portion 72 terminating in a foot 73 having a flat support surface 74. The other end of the straight stem 71 as shown is integral with a straight seat assembly support portion 76 connected to the stem 71 by a 90° elbow portion 77 and has an aperture 79 through the opposed faces of the tubular member near the free end thereof. The leg member 60 and the leg member 70, as illustrated, are tubular and square in transverse cross-section, both having the same flat to flat dimensions. The leg members 60 and 70 are connected to each other to provide a double leg member and also maintained in predetermined spaced relation by means of a pair of spacer plates 80 and 81 welded or otherwise appropriately secured to the straight portions 61 and 71 of the leg members, respectively.

The leg member 90 of double leg member 90 and 100, as shown, is tubular, square in transverse cross-section and includes a straight stem 91 which at one end thereof is integral with a gently curved portion 92 terminating in a foot 93 having a flat support surface 94. The other end of the straight stem 91, as shown is integral with a straight seat assembly support portion 96 joined to the straight stem by a 90° elbow 97. The entire leg member 90 is generally U-shaped with the straight stem 91 forming the bight and with the seat support portion 96 and the curved leg portion 92 forming the legs.

Leg member 100 of double leg member 90 and 100 is tubular, square in transverse cross-section and includes a straight stem 101 which at one end thereof is integral with a gently curved leg portion 102 terminating in a foot 103 having a flat support surface 104. The other end of the straight stem 101, as shown, is integral with a straight seat assembly support portion 106 connected to the stem 101 by a 90° elbow portion 107 and has an aperture 109 through the opposed faces of the tubular member near the free end thereof. The leg member 90 and the leg member 100, as illustrated, are tubular and square in transverse cross-section, both having the same flat to flat dimensions, and the same dimensions as leg members 60 and 70. The leg members 90 and 100 are connected to each other to provide a double leg member and also maintained in predetermined spaced relation by means of a pair of spacer plates 110 and 111 welded or otherwise appropriately secured to the straight stem portions 91 and 101 of the leg members respectively.

A U-shaped cross bar 115 as shown is tubular, square in transverse cross-section and includes a straight stem 116 which at each end thereof is integrally formed into a leg portion 117 having the free end thereof curved through substantially 90° of arc to form a curved surface 118. The leg portions 117 are each connected to the stem 116 through a 90° elbow portion 119. The U-shaped cross bar 115 as well as the leg members 60, 70, 90 and 100, as shown, are each tubular and square in transverse cross-section, all having the same flat to flat dimensions.

Figure 2:
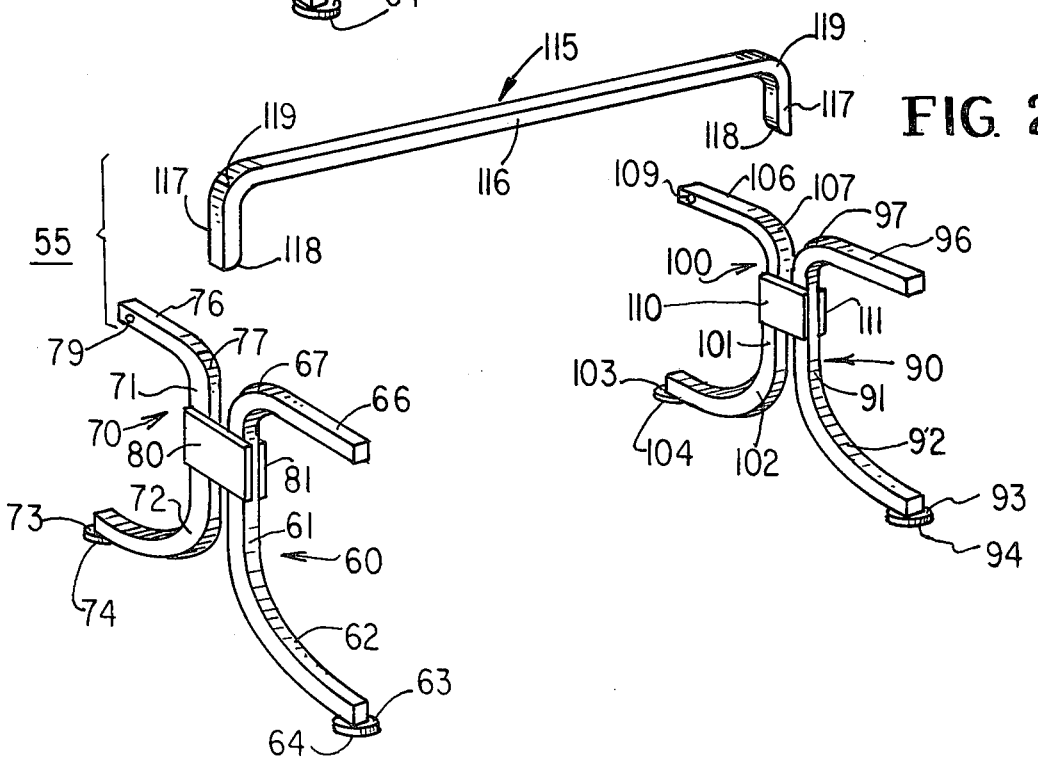
FIG. 2 is an exploded perspective view of a pair of double leg members and cross bar aligned for interfitting.
Figure 3:
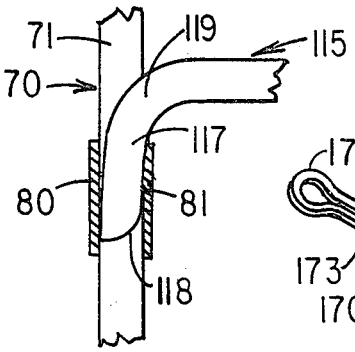
FIG. 3 is a fragmentary view of a leg member illustrated in FIG. 2 with the cross bar in place illustrating the wedging action.

As illustrated in FIGS. 2 and 3, the U-shaped cross bar 115 frictionally fits into the openings formed by the two leg members and the associated spacer plates to form the rigid leg assembly 55. Specifically, the opening defined by each connected pair of leg members is square in transverse cross-section and has substantially the same outer dimension as the cross bar 115. As the U-shaped cross bar 115 is pushed downwardly into the openings of the double leg members 60, 70, 90 and 100, assistance with a tool such as a hammer may be needed. The leg portions 117 of cross bar 115 and the elbow portions 119 co-act with the adjacent spacer plates 80 and 81 as well as spacer plates 110 and 111 to wedge the cross bar into the respective double leg member and to lock the leg assembly 55 and form an entirely rigid structure for supporting the seat assembly 120. The curved surfaces 118 at the end of the leg portions 117 of cross bar 115 permit the leg portions 117 to enter the spaces between the spacer plates.

Figure 4:
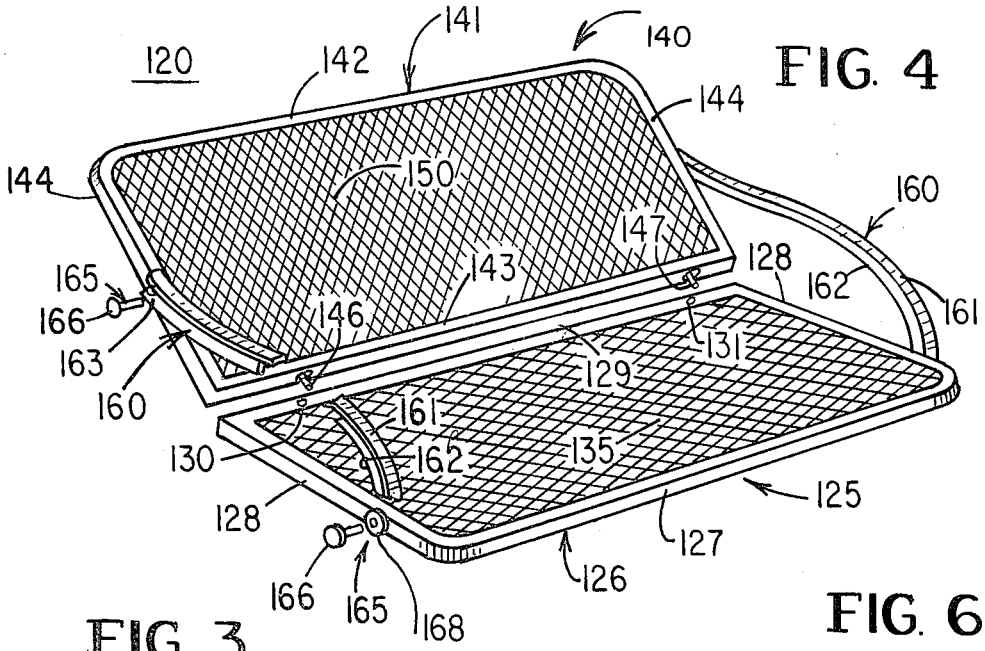
FIG. 4 is a perspective view of the seat assembly of the present invention in an intermediate position thereof between the operative position and the storage position.
Figure 6:
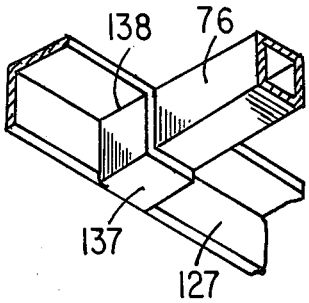
FIG. 6 is an enlarged perspective view of one of the connection means between the seat assembly and a leg member at the front of the seat assembly.

The seat assembly 120 (FIG. 4) includes a seat 125 defined by a generally rectangular seat frame 126, the members thereof, as shown, being of metal and of right angle cross-section. The seat frame 126, as shown, is straight along the sides 128 and along the front 127 and the rear 129. Spaced apart apertures 131 and 132 are provided in the rear 129 of the seat frame 126 and spaced apart right angle trapping members 137 or the like (FIG. 6) are fixedly connected or mounted to the front 127 of the seat frame 126 by means of the appropriate welds 138. Mesh or other desired material 135 forms the sitting or support surface for the seat 125 and is suitably connected by means (not shown) to the seat frame 126.

Figure 5:
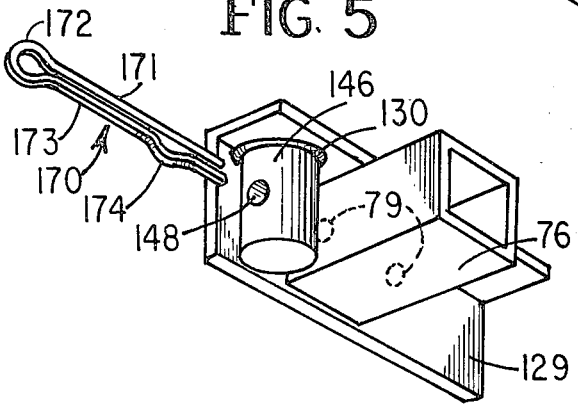
FIG. 5 is an enlarged perspective view of one of the detachable connection means between the seat assembly and a leg member at the rear of the seat assembly.

The seat assembly 120 further includes a back 140 defined by a generally rectangular back frame 141, the members thereof, as shown, of metal and of right angle cross-section. The back frame 141 includes a back frame top 142 and a substantially parallel back frame bottom 143 interconnected by back frame sides 144. All the members 142, 143 and 144, as shown, are right angle in cross-section, and of the same dimension as the members of seat frame 126. Spaced apart short cylindrical studs 146 and 147, (FIG. 4) each with an aperture 148 (FIG. 5) therethrough, depend from the back frame bottom 143 and have a diameter slightly smaller than the diameter of the apertures 130 and 131 in the seat frame rear 129. Mesh or other desired material 150 is suitably connected to the back frame 141.

Two substantially identical sinuous arms 160 are provided, each, as shown, being of right angle shape in transverse cross-section and having a support surface 161 and a attachment surface 162 and having apertures 163 in the attachment surface 162 near the free ends thereof. The arms 160 are pivotally mounted by means 165 to both the seat 125 and the back 140 and more particularly to the seat frame 126 sides 128 and the back frame 141 sides 144. Specifically, pivot connection means 165 each include a rivet 166 extending through the associated aperture 163 in the attachment surface 162 of the arm 160 and an aperture (not shown) in the associated frame member, either the back frame side 144 or the seat frame side 128. Each of the rivets 166 has a washer 168 intermediate the associated arm 160 and the associated frame sides 128 and 144, respectively. Washers 168 enable a suitable finish to be applied to the frame members and the rivet 166 ensures that the pivotal connection between the arms 160 and the associated seat 125 and the back 140 remains secure.

Two cotter pins 170 or the like (FIG. 5) each having a flat base portion 171, and eyelet elbow portion 172 and an overlapping spring portion 173 having a raised portion 174 are provided to detachably connect the associated studs 146 and 147 after passing through apertures 130 and 131 in rear 129 of seat frame 126 with the respective one of the seat support portions 76 and 106 of the leg assembly 55 by passing through the aligned apertures 79 and 109 and 148.

The cotter pins 170 serve to ensure a secure attachment such that the seat 125 and the back 140 are in fixed operative relation and rigidly connected to each other and to the leg assembly 55, thereby to provide the rigid and solid construction previously unattainable in prior art knockdown furniture. The rigid construction is further aided by the wedging action of the ends 117 of cross bar 115 in the apertures formed by the double leg members 60–70 and 90–100 and the associated spacer plates 80, 81, and 110, 111, respectively, which combine to form the leg assembly 55. Additionally, the secure frictional engagement of the seat supports 66 and 96 in the trapping members 137, combined with the pinned connection of the seat supports 76 and 106, respectively, to the studs 146 and 147 provide four securement points for the leg assembly 55 to the already rigid seat assembly 120.

Figure 7:
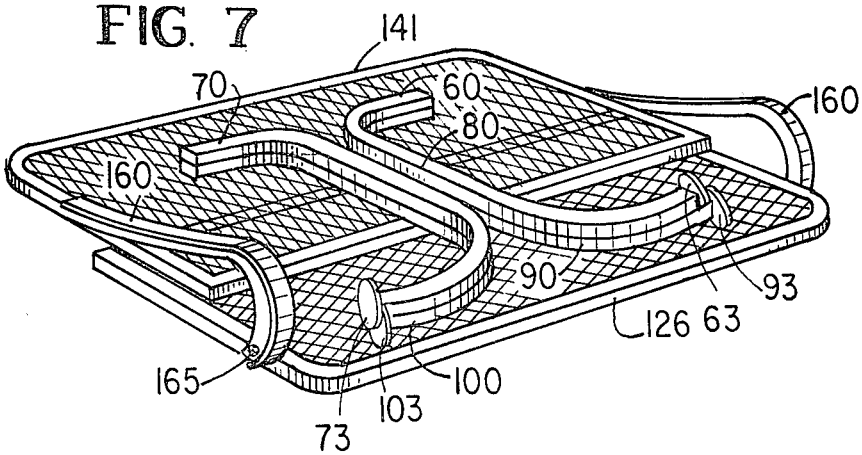
FIG. 7 is a perspective view of the seat assembly in the storage position thereof and the double leg members and cross bar disassembled and positioned for packaging.

Removal of the two cotter pins 170 permits disengagement of the studs 146 and 147 from the apertures 130 and 131 and pivoting movement of the seat assembly 120 with the seat 125 pivoting with respect to the back 140 at the four pivot points provided by the rivets 166 at the arms 160 and the associated sides 128 and 144, respectively of the seat 125 and the back 140, from the rigid operative position illustrated in FIG. 1 to the folded or storage position illustrated in FIG. 7. In the folded or storage position, the back 140 substantially overlies and engages the seat 125 between the arms 160. The leg assembly 55 having been disassembled into a pair of double leg members fits with the separated cross bar 115 intermediate the arms 160, and most importantly, the pair of double leg members stacked on the overlying seat 125 and the back 140 as well as the cross bar 115 do not exceed the level of the arms 160, thereby to provide a compact unit for packaging, shipping and storage. The thickness of the package is defined by the level of the arms 160 and this compact package is smaller than is presently available in knockdown settee.

It is clear that various materials may be utilized for the leg assembly 55 and the seat assembly 120, with metal or a synthetic organic resin being preferred. Where a synthetic organic resin is used, connection means specifically designed for use with synthetic organic resins are employed. It is also clear that the principal objects of the present invention have been attained by providing, as described heretofore, a knockdown settee 50 which when assembled is entirely rigid and undiscernible from a permanently assembled settee, yet when disassembled to the knockdown condition is compact for shipping.

While there has been described what at present is considered to be the preferred embodiment of the present invention, various modifications and alterations may be made therein without departing from the true spirit and scope of the present invention and it is intended to cover in the claims appended hereto all such modifications and alterations.

What is claimed is:

1. A knockdown settee, comprising: a pair of double leg members each including two legs, two seat assembly supports and connecting spacer structure defining an opening having a pair of parallel sides, said legs and said supports disposed in a generally common plane parallel with said parallel sides of said opening of said spacer structure; a U-shaped cross bar having two legs connected by a bight adapted detachably to connect said pair of double leg members rigidly in operative position, the legs of said cross bar being disposed within the spacer structure openings of said pair of double leg members to function as wedges and to establish the detachable rigid connections between said cross bar and said pair of double leg members; a seat assembly including a seat, a back and a pair of arms pivoted at the free ends respectively to the sides of said seat and said back; means rigidly connecting the rear of said seat to said back when said back is pivoted by said arms to operative position; and spaced means at the bottom of said seat for attaching engagement of adjacent seat assembly supports of said pair of double leg members connected by said cross bar; whereby said knockdown settee is readily and rigidly assembled by said cross bar, and when disassembled said seat and said back are moveable by said pivoted arms into substantial alignment and said double leg members and said cross bar when separated may lie on said seat and back below the level of said arms, thereby minimizing space required for packaging and storage.

2. The knockdown settee of claim 1 wherein a pair of said spaced means at the bottom of said seat are right angle brackets at the front of said seat bottom frictionally engaging the associated seat assembly supports.

3. A knockdown settee, comprising: a pair of double leg members each including two legs, two seat assembly supports and connecting spacer structure defining an opening having a pair of parallel sides, said legs and said supports disposed in a generally common plane parallel with said parallel sides of said opening of said spacer structure; a U-shaped cross bar having two legs connected by a bight adapted detachably to connect said pair of double leg members rigidly in operative position, the free ends of said cross bar curved through substantially 90° and disposed within the spacer structure openings of said pair of double leg members, the legs of said cross bar functioning as wedges establish the detachable rigid connections between said cross bar and said pair of double leg members; a seat assembly including a seat, a back and a pair of arms pivoted at the free ends respectively to the sides of said seat and said back, said back having a pair of spaced studs adapted to extend through spaced openings at the rear of said seat when said back is pivoted by said arms to operative position, said seat at the front bottom having a pair of spaced means for attaching engagement of the front seat assembly supports of said pair of double leg members when connected by said cross bar; and a pair of detachable means connecting the rear seat assembly supports of said connected pair of double leg members to said studs at the rear bottom of said seat when said back is in operative position, whereby said knockdown settee is readily and rigidly assembled by said cross bar and said pair of detachable means, and when disassembled said seat and said back are moveable by said pivoted arms into substantial alignment and said double leg members and said cross bar when separated may lie on said seat and back below the level of said arms, thereby minimizing space required for packaging and storage.

4. The knockdown settee of claim 3 wherein said seat and said back are edged by metallic members, said spaced openings at the rear of said seat extending through a metallic member, said pair of spaced means for attaching engagement of said front seat assembly supports being mounted on a metallic member and said pair of arms being pivoted to metallic members of said seat and said back.

5. The knockdown settee of claim 3 wherein said arms are metallic members of right angle cross-section, and wherein rivets and intermediate washers establish the pivotal relationship between said arms and said seat and said back, said washers providing space for applying and preserving a finish at the pivot areas.

6. The knockdown settee of claim 3 wherein said seat and back include metallic mesh material.

7. The knockdown settee of claim 3 wherein said detachable means connecting the rear seat assembly supports to said studs are pins extending through aligned openings in said studs and said supports, whereby a rigid relationship is established between said connected double leg members and said seat assembly.

8. The knockdown settee of claim 3 wherein each double leg member includes two generally U-shaped leg-support components, said spacer structure being a pair of plates secured to opposite sides of intermediate portions of said U-shaped components.

9. The knockdown settee of claim 8 wherein said U-shaped leg-support components are square in transverse cross-section, wherein said cross bar has a transverse cross-section of the same square size, and wherein said opening in said spacer structure has a transverse cross-section of substantially the same square size.

* * * * *